US007806726B2

(12) United States Patent
Chen et al.

(10) Patent No.: US 7,806,726 B2
(45) Date of Patent: Oct. 5, 2010

(54) RF MICROWAVE CONNECTER FOR TELECOMMUNICATION

(75) Inventors: Sung-Wen Chen, Hsin-Tien (TW); Tung-Liang Huang, Hsin-Tien (TW)

(73) Assignee: Insert Enterprise Co, Ltd., Hsin-Tien, Taipei Hsien (TW)

( * ) Notice: Subject to any disclaimer, the term of this patent is extended or adjusted under 35 U.S.C. 154(b) by 548 days.

(21) Appl. No.: 11/898,489

(22) Filed: Sep. 12, 2007

(65) Prior Publication Data

US 2010/0151729 A1 Jun. 17, 2010

(30) Foreign Application Priority Data

May 8, 2007 (TW) ..... 96207382 U

(51) Int. Cl.
*H01R 9/05* (2006.01)

(52) U.S. Cl. ..... 439/582

(58) Field of Classification Search ..... 439/63, 439/582

See application file for complete search history.

(56) References Cited

U.S. PATENT DOCUMENTS 6,712,645 B1 * 3/2004 Chou ..... 439/582
7,351,067 B2 * 4/2008 Chen et al. ..... 439/63
7,367,840 B2 * 5/2008 Chen et al. ..... 439/581
7,467,973 B2 * 12/2008 Lee et al. ..... 439/582

* cited by examiner

*Primary Examiner*—Tho D Ta

(57) ABSTRACT

In a RF microwave connecter for telecommunication, a upper end surface of a central terminal is provided with a sheet type connection portion; whereby, when an inner conducting wire of a coaxial cable is placed on the upper sides of said upper end surface and said connection portion of said central terminal, said connection portion and said sheet are then further allowed to bend to cause said inner conducting wire to be thrust into said fixing groove and a lower end of said insulating sheet to be positioned in said groove to compress the upper side of said inner conducting wire to enable the central terminal and the inner conducting wire to be coupled stably. Furthermore, the central terminal of the connecter is allowed to manufacture more easily.

15 Claims, 8 Drawing Sheets

RF MICROWAVE CONNECTER FOR TELECOMMUNICATION

BACKGROUND OF THE INVENTION

1. Field of the Invention

The present invention relates to an electric connecter, and more particularly to a RF (radio frequency) microwave connecter for telecommunication.

2. Description of Related Art

Please refer to FIGS. 1A, 1B and 1C. U.S. Pat. No. 6,790,082 discloses a coaxial cable connecter; it allows a hollow portion of an insulator 11 to be coupled to a central terminal; the upper end of the insulator 11 is provided with a groove 111 and a bendable sheet 112 extended upward; the upper end of the central terminal is connected to a first clamping sheet 121 and a second clamping sheet 122. One end of the first clamping sheet 121 is placed in the groove 111 of the insulator 11. One end of the second clamping sheet 122 is connected with one end of the first clamping sheet 121; another end of the second clamping sheet 122 is positioned above the first clamping sheet 121. A metal housing 13 is further allowed to couple to the insulator 11; one side of the metal housing 13 is coupled to a buckling portion 131; the buckling portion 131 is provided with a plurality of pairs of tabs 132, 133, 134 and 135 are respectively extended outward two sides thereof as FIG. 1A shows. An inner wire 21 of a coaxial cable 20 is further allowed to place in the groove 111 and above the first clamping sheet 121, an inner insulator layer 22 of the coaxial cable 20, ground conductor layer 23 and outer insulator layer 24 are respectively positioned at the outside of the groove 111 as FIG. 1B shows. Furthermore, the buckling portion 131 is caused to bend 90 degrees to be leaned against the upper edge of the metal housing 11 to allow the inner conducting wire 21 to be sandwiched between the first clamping sheet 122 and the first clamping sheet 121, the sheet 112 is suppressed at the upper side of the second clamping sheet 122 to enable the second clamping sheet 122 and the buckling portion 131 not to contact with each other. And then, the pairs of tabs 132, 133, 134 and 135 are further bended to cause the tabs 132 and 133 to respectively buckle the metal housing 11 and the tabs 134 and 135 to respectively buckle the ground conductor layer 23 and the outer insulator layer 24 as FIG. 1C shows.

The connecter assembling manner mentioned above allows the coaxial cable 20 to be coupled to the central terminal at the same time that the buckling portion 131 is bended; it is rather time saving for the manufacturing. But, the structure that the first and the second clamping sheets 121 and 122 are disposed on the upper end of the central terminal is rather not easy to be manufactured and rather high for the manufacturing cost. Furthermore, because the first and the second clamping sheets 121 and 122 are made from harder metal, they can rather not clamp the inner conducting wire 21 tightly. When the distance between the first and the second clamping sheets 121 and 122 after being bended cannot match up with the diameter of the inner conducting wire 21, the first and the second clamping sheets 121 and 122 can rather not clamp the inner conducting wire 21 stably; it will influence the signal transmission quality and the coaxial cable in use is rather easy to be loosed if an improper pull force is exerted.

U.S. Pat. No. 7,025,598 discloses a coaxial electric connecter; it provides a coaxial connecter capable of preventing a tongue part of a dielectric from being inclined while being bended and shrinking the height of the tongue part and a cover to attain to the shortness of the connecter. However, the tongue part is not used to match up with a connection part of a central conductor to sandwich an inner conducting wire of a cable. The inner wire is soldered on the connection part of the central conductor. A soldering step is necessary to be added in the manufacturing of the connecter; it rather wastes the labor hour and increases the product cost.

Taiwan Patent No. M307242 and Taiwan Patent N0. M307242 respectively disclose two different RF microwave connecters for telecommunication; they mainly allow the upper end of a central terminal to be provided with a guiding groove and fixing groove; the diameter of the cross section of the guiding groove is larger than the diameter of an inner conducting wire of a coaxial cable, and the diameter of the cross section of the upper end of the fixing groove is smaller than the diameter of the inner conducting wire. Utilizing a particular design that only the inner conducting wire can enter the fixing groove after being thrust allows the inner wire in the fixing groove to be thrust by the wall of the fixing groove to enable the coupling of a central terminal and the inner conducting wire to be more stable and the signal transmission quality to be better. However, a several plate bending steps are necessary to be processed when the central terminal is manufactured, the structures of the guiding groove and the fixing groove can then be formed. As the manufacturing steps is rather complex, it results in the lower production speed and the higher defective rate. Besides, more molds are needed such that the mold fabrication cost is higher.

SUMMARY OF THE INVENTION

For improving a coupling structure of a central terminal of a RF microwave connecter for telecommunication and an inner conducting wire of a coaxial cable to allow the manufacturing to be more convenient and the defective rate to be decreased, the present invention is proposed.

The main object of the present invention is to provide a RF microwave connecter for telecommunication, allowing a central terminal of the connecter and an inner conducting wire of a coaxial wire to be coupled to each other more easily and more time-saving.

Another object of the present invention is to provide a RF microwave connecter for telecommunication, allowing a central terminal of the connecter to be manufactured more easily, the production cost is saved and the production yield is elevated.

BRIEF DESCRIPTION OF THE DRAWINGS

The present invention can be more fully understood by reference to the following description and accompanying drawings, in which:

FIGS. 7A, 7B and 7C are schematic views, respectively showing the assembly processes of a connecter of the second embodiment according to the present invention;

DETAILED DESCRIPTION OF THE PREFERRED EMBODIMENTS

Figures 1A, 1B, 1C:
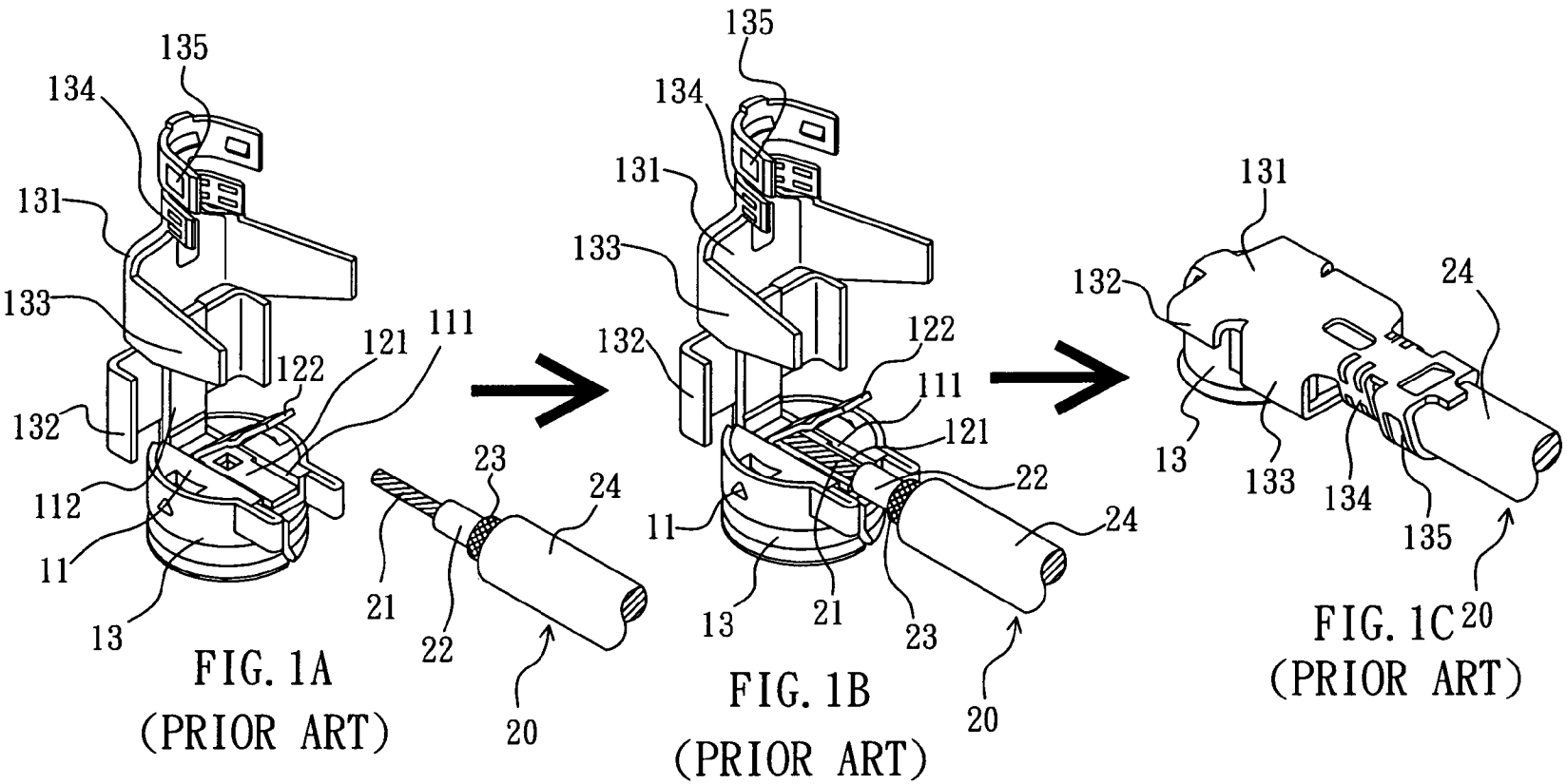
FIG. 1A (PRIOR ART)
FIG. 1B (PRIOR ART)
FIG. 1C (PRIOR ART)
FIGS. 1A, 1B and 1C are schematic views, respectively showing the assembly processes of a conventional connecter.

Please refer to FIGS. 2, 3A to 3C, 4A to 4C, 5A and 5B. A RF microwave connecter according to the present invention is adapted to allow the manufacturing of the connecter to be more time saving. A connecter of a first preferred embodiment according to the present invention comprises a metal housing 31, a plastic insulator 33 and a central terminal 36.

A coupling portion 32 is extended upward from the upper end of the metal housing 31, the coupling portion 32 is provided with a middle element 321 and a first pair of tabs 322, a second pair of tabs 323, a third pair of tabs 324 and a fourth pair of tabs 325 are extended outward from two sides of the middle element 321; a pair of L-type arms 311 and 312 extended outward are disposed on the metal housing opposite to the coupling portion 32, in which there is a spacing 313 between the two L-type arms 311 and 312.

The plastic insulator 33 is put around the inner side of the metal housing 31, the plastic insulator 33 is provided with a hollow portion 331; the upper end of the plastic insulator 33 is provided with a bendable sheet 34 extended upward and a projection portion 35 extended outward levelly; the projection portion 35 is accepted between the two L-type arms 311 and 312. The sheet 34 is positioned opposite to the projection portion 35; the projection portion 35 is provided with a first groove 351 and a second groove 352 communicated with each other, in which the diameter of the cross section of the second groove 352 positioned above the first groove 351 is larger than the diameter of the cross section of the first groove 351; the sheet 34 is provided with a first projection portion 341 and a second projection portion 342 respectively corresponding to the first groove 351 and the second groove 352.

The central terminal 36 is engaged with the hollow portion 331 of the plastic insulator 33; an upper end surface 361 of the central terminal 36 is provided with a sheet type connection portion 362; the lower end of the central terminal 36 is provided with two opposite contact sheets 363 adapted to clamp a male terminal.

Figures 3A, 3B, 3C:
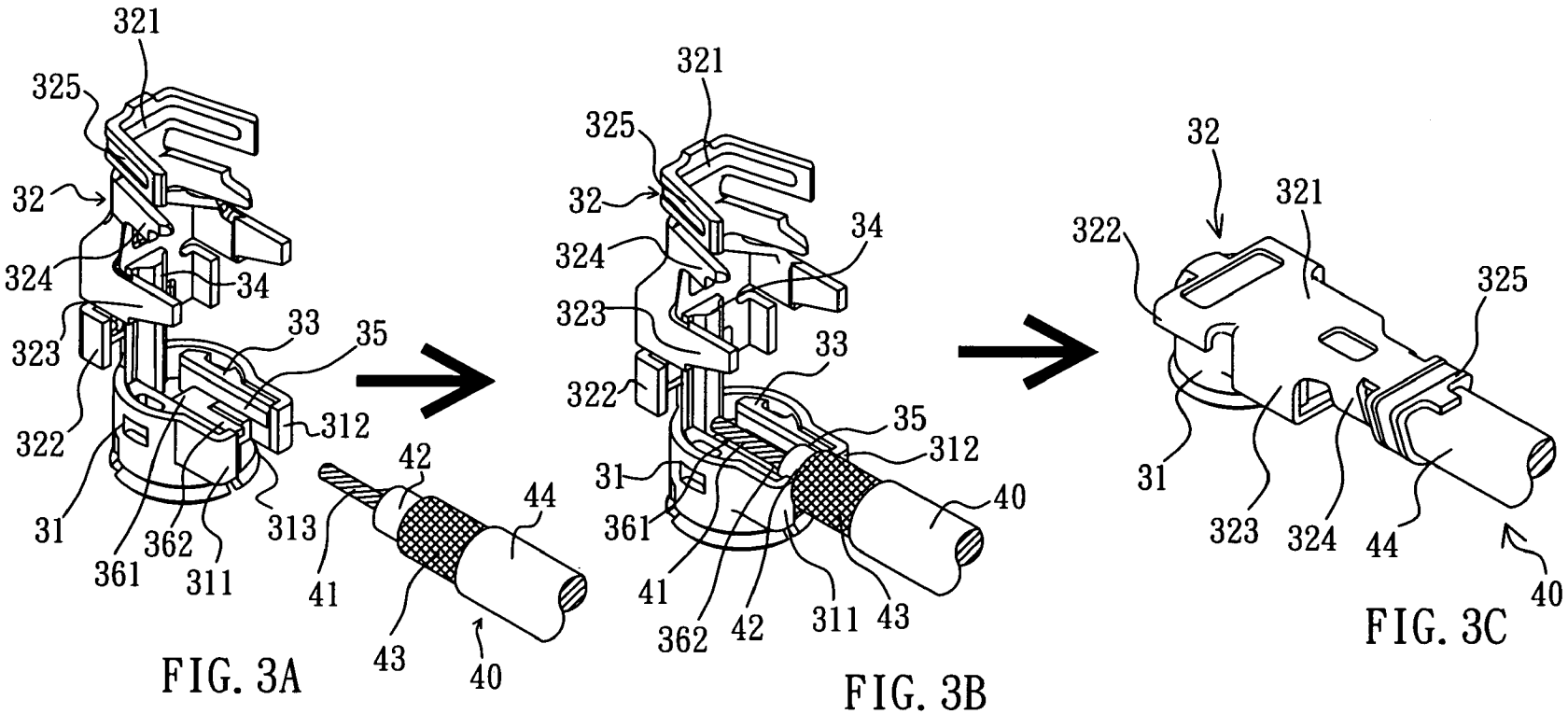
FIGS. 3A, 3B and 3C are schematic views, respectively showing the assembly processes of a connecter of the first embodiment according to the present invention.
Figures 4A, 4B, 4C:
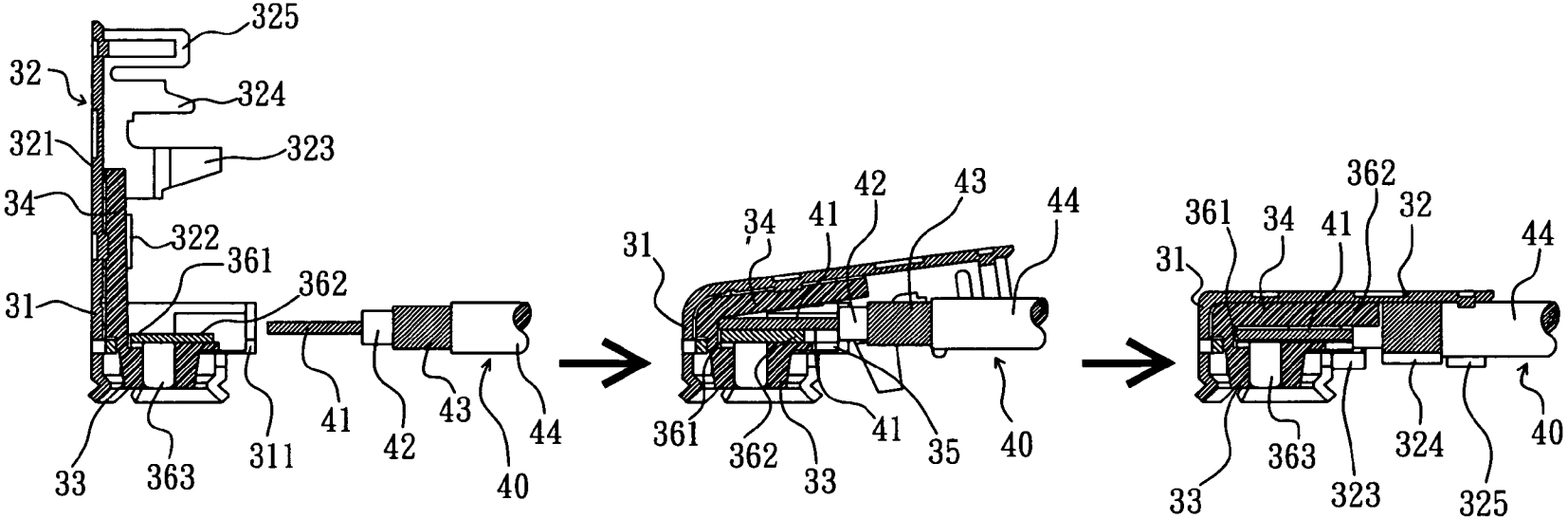
FIGS. 4A, 4B and 4C are schematically cross sectional views, respectively showing the assembly processes of a connecter of the first embodiment according to the present invention.
Figure 5B:
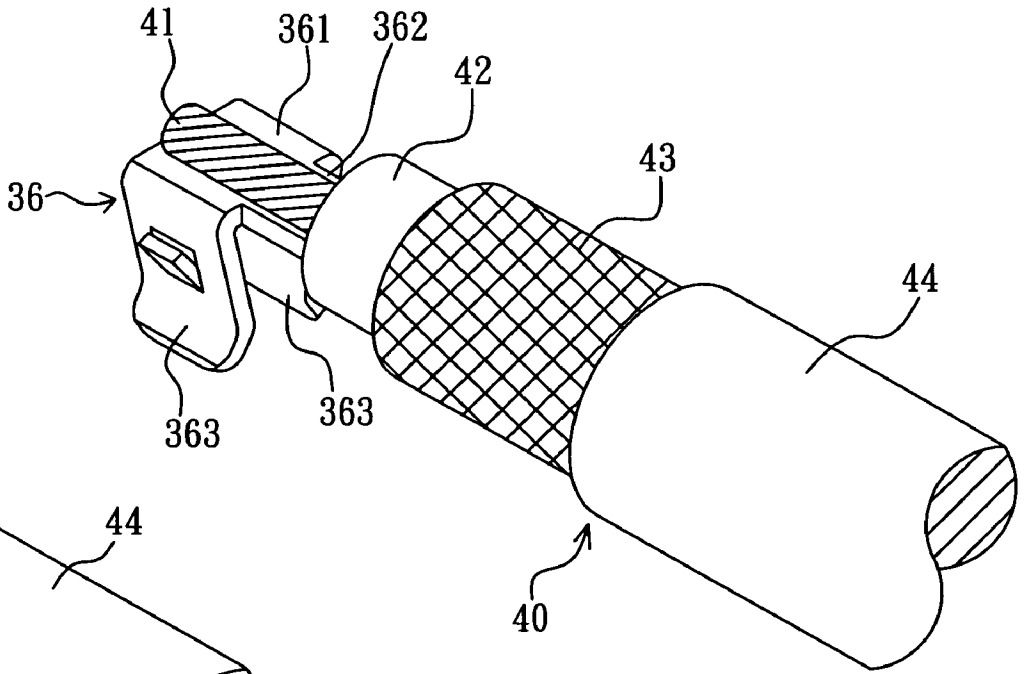
FIG. 5B is a perspective view, showing a central terminal of the first embodiment according to the present invention and an inner wire of a coaxial cable in a folding state.
Figure 5A:
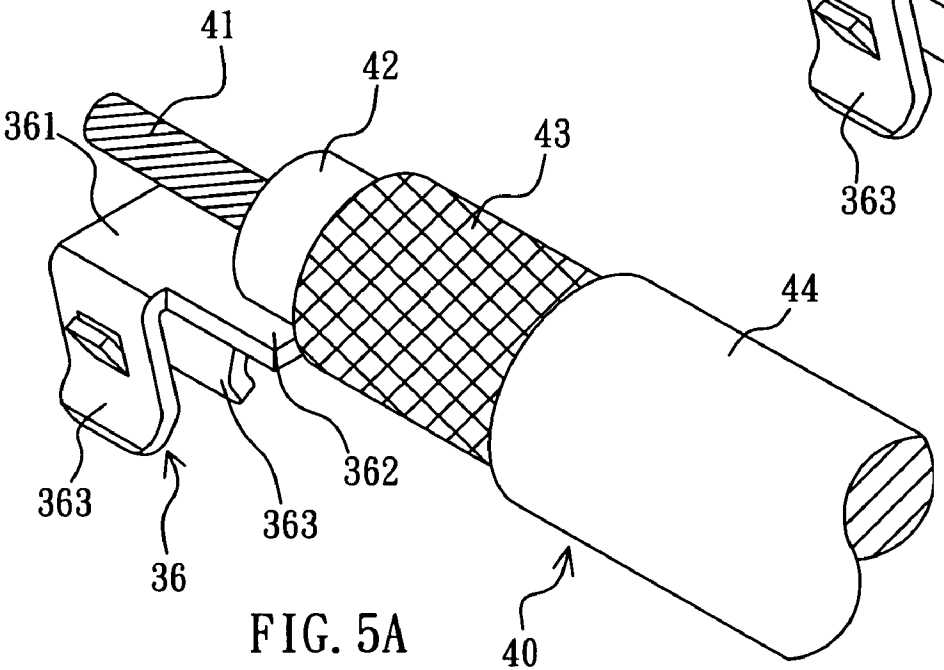
FIG. 5A is a perspective view, showing a central terminal of the first embodiment according to the present invention and an inner wire of a coaxial cable in a separation state.

The connection portion 362 of the central terminal 36 is positioned in the first groove 351 of the projection portion 35. When an inner conducting wire 41 is caused to position on the .upper sides of the upper end surface 361 and the connection portion 362 of the central terminal 36 and in the first groove 351 and in the meantime, an inner insulator layer 42 of a coaxial cable 40 is placed between the two L-type arms 311 and 312 and extended to the outside of the two L-type arms 311 and 312 as FIGS. 3B, 4B and 5B show, the coupling portion 32 is then bended to cause the sheet 34 to be bended downward to thrust the inner conducting wire 41 to enable the inner conducting wire 41 to compress the upper end surface 361 and the connection portion 362 of the central terminal 36 to allow the upper end surface 361 and the connection portion 362 to be deformed to attach the inner conducting wire 41 closely, and to cause the second projection portion 342 and the first projection portion 341 of the insulating sheet 34 to be respectively positioned in the second groove 352 and the first groove 351 and compress the upper side of the inner conducting wire 41 to allow the inner conducting wire 41 and the coupling portion 32 not to contact with each other as 3B, 4B and 5B show. In the meantime, the first pair of tabs 322 is buckled on the upper end of the outside of the metal housing 31, the second pair of tabs 323 is buckled on the outside of the two L-type arms 311 and 312, and the third pair of tabs 324 and the fourth pair of tabs 325 are respectively buckled on the ground conductor layer 43 and the outside insulator layer 44 of the coaxial cable 41 as FIGS. 3C and 4C show.

Please refer to FIGS. 6A, 6B, 7A to 7C, 8A and 8B. A RF microwave connecter of a second preferred embodiment according to the present invention comprises a metal housing 71, a plastic insulator 73 and a central terminal 76.

A coupling portion 72 is extended upward from the upper end of the metal housing 71, the coupling portion 72 is provided with a middle element 721 and a first pair of tabs 722, a second pair of tabs 723, a third pair of tabs 724 and a fourth pair of tabs 725 are extended outward from two sides of the middle element 721; a pair of L-type arms 711 and 712 extended outward are disposed on the metal housing opposite to the coupling portion 72, in which there is a spacing 713 between the two L-type arms 711 and 712.

The plastic insulator 73 is put around the inner side of the metal housing 71, the plastic insulator 73 is provided with a hollow portion 731; the upper end of the plastic insulator 73 is provided with a bendable sheet 74 extended upward and a projection portion 75 extended outward levelly; the projection portion 75 is accepted between the two L-type arms 711 and 712. The sheet 74 is positioned opposite to the projection portion 75; the projection portion 75 is provided with a groove 751, in which the sheet 14 is corresponding to the groove 751.

The central terminal 76 is engaged with the hollow portion 731 of the plastic insulator 73; an upper end surface 761 of the central terminal 76 is provided with a sheet type connection portion 762; the lower end of the central terminal 76 is provided with a round bar type male terminal 763 used for clamping between two contact sheet of a female terminal.

Figure 6B:
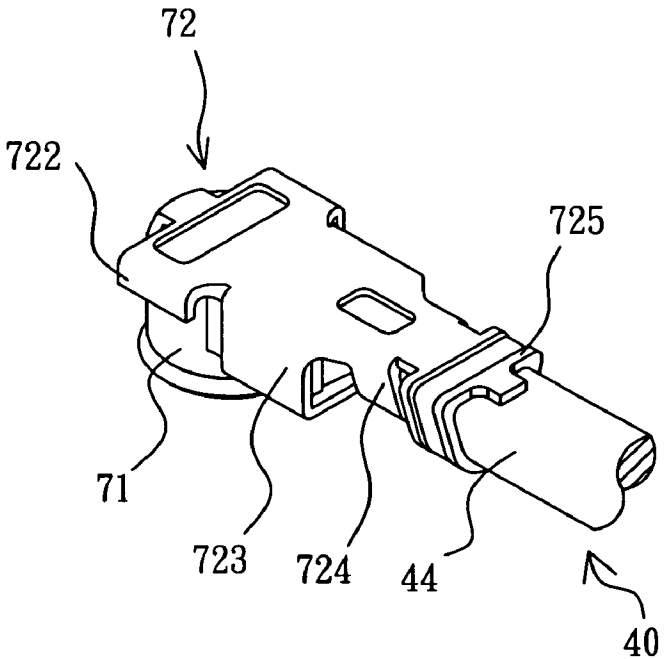
FIG. 6B is a perspective view, showing each component of a connecter of the second embodiment according to the present invention and a coaxial cable in a coupling state.
Figure 6A:
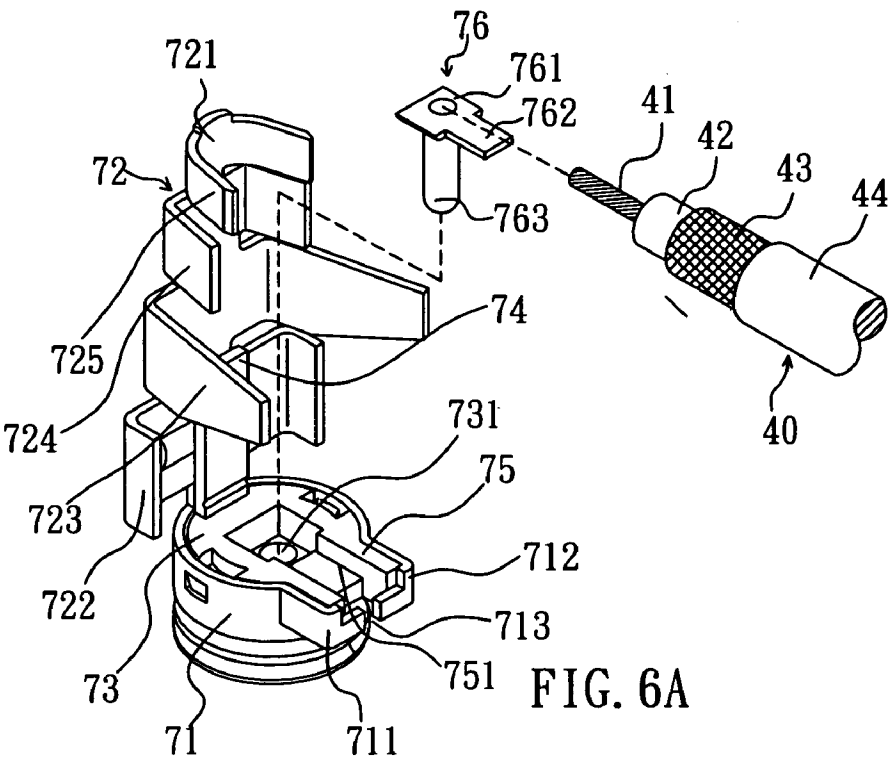
FIG. 6A is a perspective view, showing each component of a connecter of a second embodiment according to the present invention and a coaxial cable in a separation state.
Figures 7B, 7C:
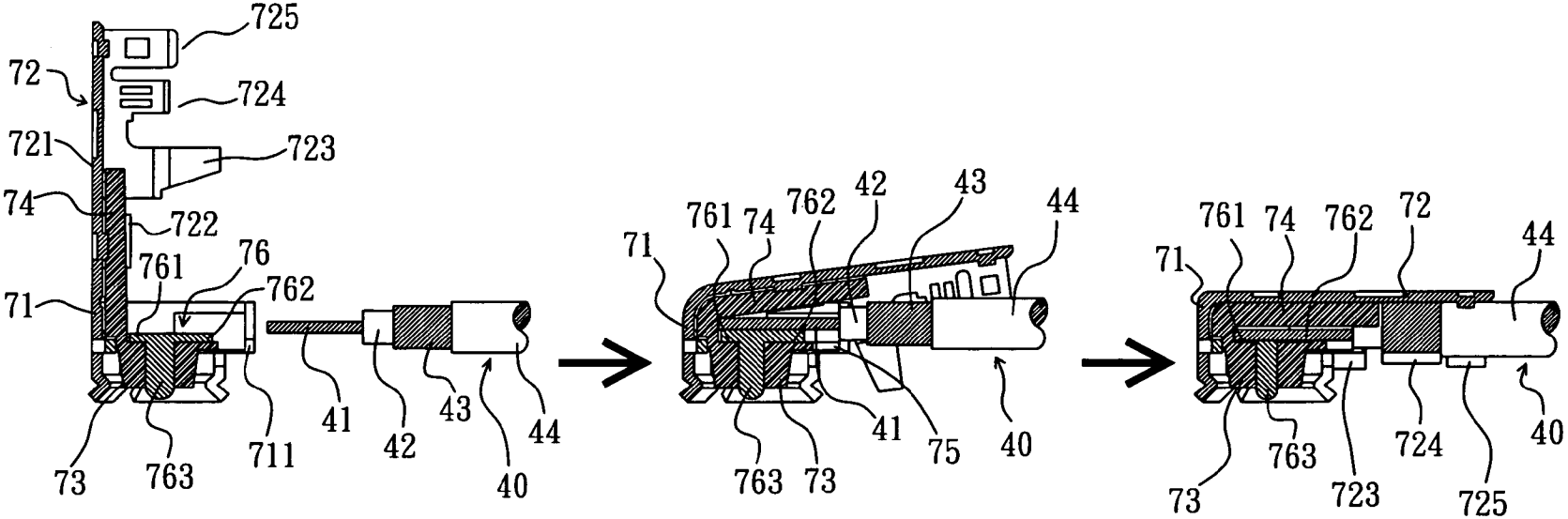
Figure 8B:
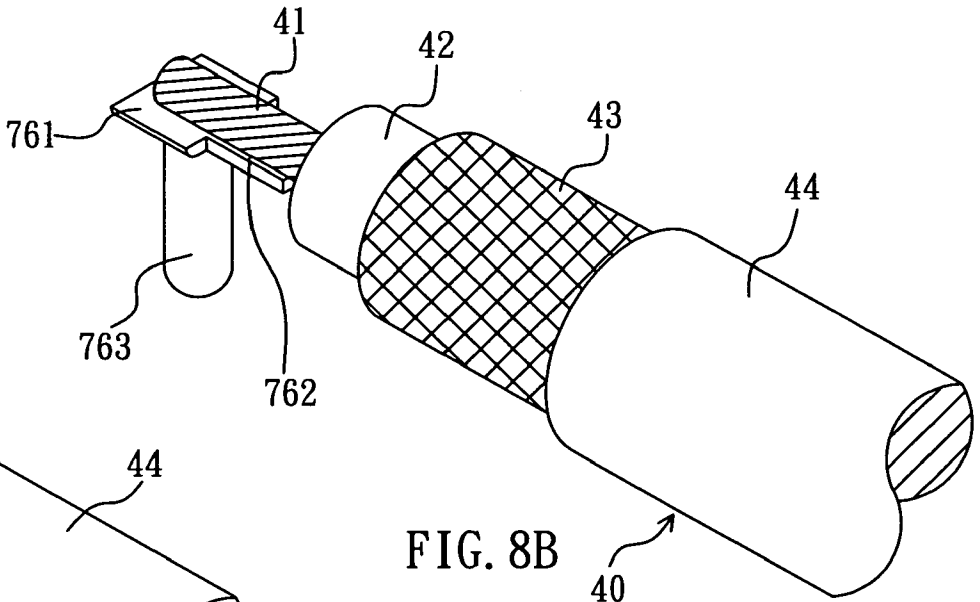
FIG. 8B is a perspective view, showing a central terminal of the second embodiment according to the present invention and an inner wire of a coaxial cable in a folding state.
Figure 8A:
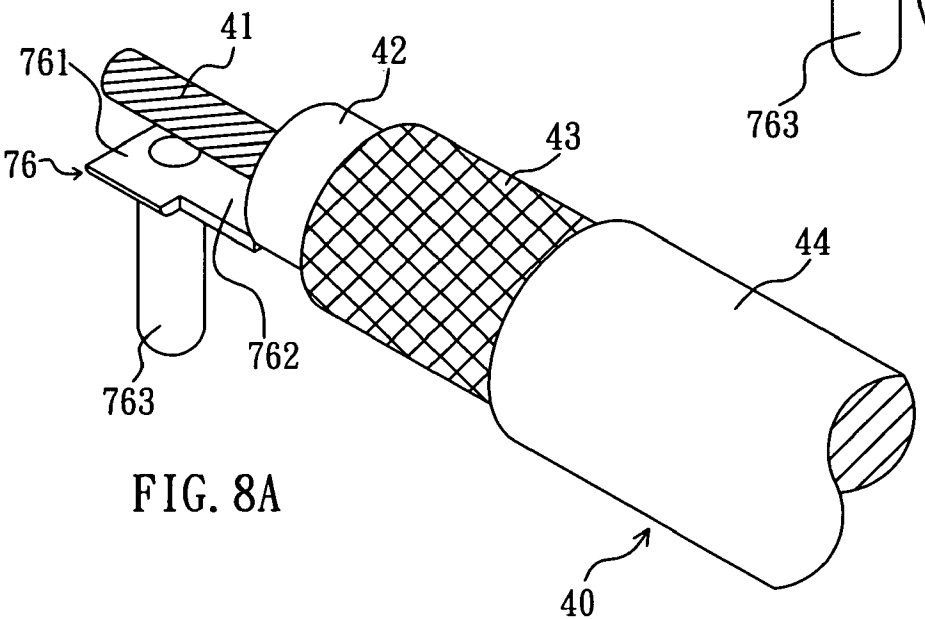
FIG. 8A is a perspective view, showing a central terminal of the second embodiment according to the present invention and an inner wire of a coaxial cable in a separation state.

The connection portion 762 of the central terminal 76 is positioned in the groove 751 of the projection portion 75. When an inner conducting wire 41 is caused to position on the upper sides of the upper end surface 761 and the connection portion 762 of the central terminal 76 and in the groove 751 and in the meantime, an inner insulator layer 42 of a coaxial cable 40 is placed between the two L-type arms 711 and 712 and extended to the outside of the two L-type arms 711 and 712, the connection portion 72 is then bended to cause the sheet 74 to be bended downward to thrust the inner conducting wire 41 to allow the inner conducting wire 41 and the coupling portion 72 not to contact with each other to enable the inner conducting wire 41 to compress the upper end surface 761 and the connection portion 762 of the central terminal 76 to allow the upper end surface 761 and the connection portion 762 to be deformed to attach the inner conducting wire 41 closely. In the meantime, the first pair of tabs 722 is buckled on the upper end of the outside of the metal housing 71, the second pair of tabs 723 is buckled on the outside of the two L-type arms 711 and 712, and the third pair of tabs 724 and the fourth pair of tabs 725 are respectively buckled on the ground conductor layer 43 and the outside insulator layer 44 of the coaxial cable 41 as FIGS. 6B and 7C shows.

Figure 2:
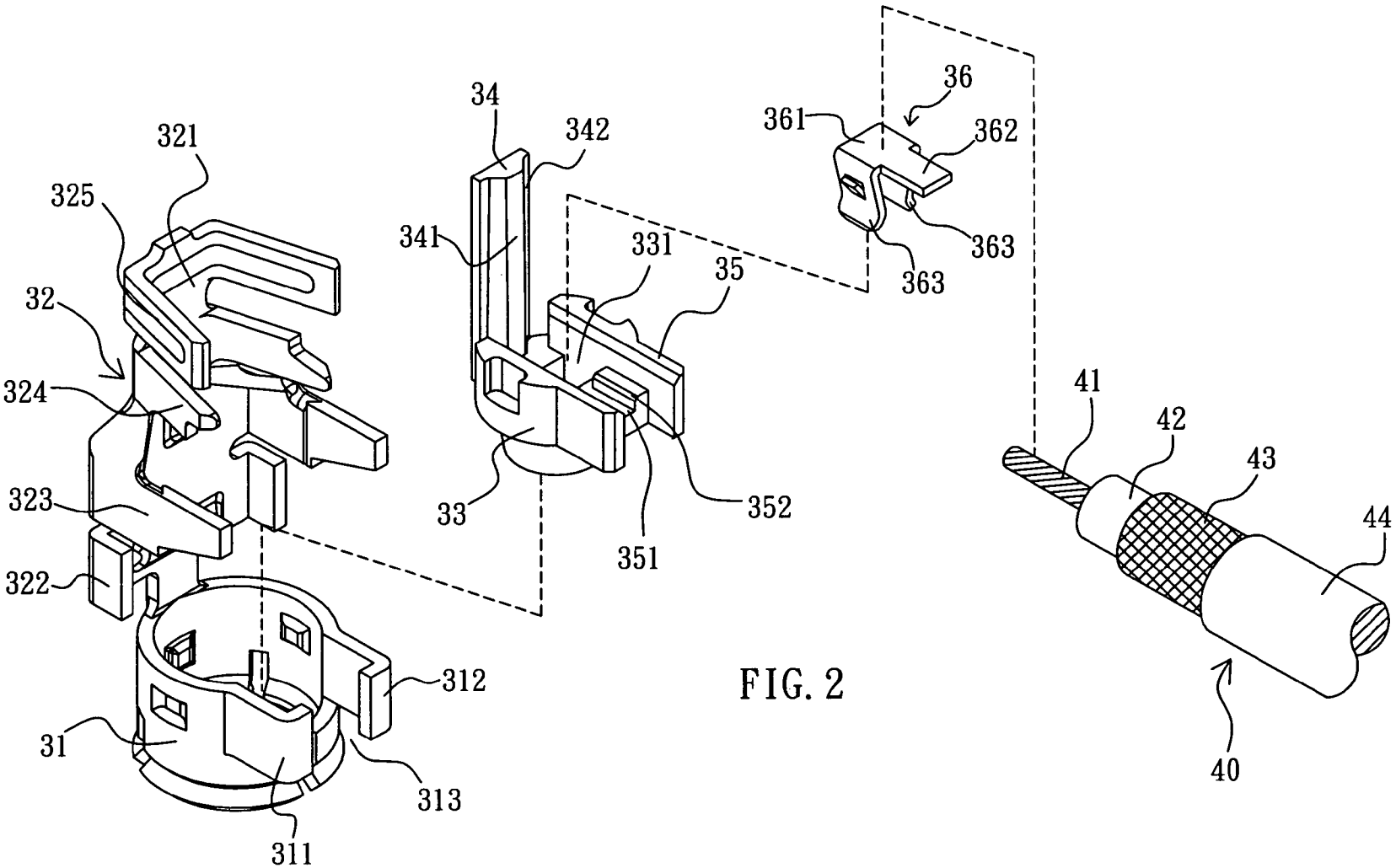
FIG. 2 is a perspective view, showing each component of a connecter of a first preferred embodiment according to the present invention and a coaxial cable in a separation state.

In the RF microwave connecter for telecommunication of the second preferred embodiment according to the present invention, the shape and the functions of the sheet 74 of the plastic insulator 73 of the connecter corresponding to the groove 751 can be a shape and functions similar to the sheet 34 of the insulator 33 with the first projection portion 341 and the second projection portion 342 respectively corresponding to the first groove 351 and the second groove 352 shown in FIG. 2, thereupon detailed figures and description are omitted here.

The present invention allows a central terminal of a connecter to be manufactured more easily and a mold fabrication to be cheaper. Besides, the coupling between the central terminal and an inner conducting wire of a coaxial cable can de done more easily and more time saving, and the central terminal of the connecter and the inner conducting wire of the coaxial cable are enabled to couple more closely and not to loose such that the manufacturing yield is elevated.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A RF microwave connecter for telecommunication comprising:

a metal housing having an upper end extending upward with a coupling portion, a pair of arms extending outward from the metal housing opposite to said coupling portion, a spacing is provided between said two arms, and said coupling portion being provided with a middle element and a plurality of pairs of tabs respectively extending outward from two sides of said middle element;

a plastic insulator, which is disposed around an inner side of said metal housing, being provided with a hollow portion, an upper end of said plastic insulator being provided with a bendable sheet extending upward and a projection portion extending outward levelly, said projection portion being accepted between said two arms, said bendable sheet being positioned opposite to said projection portion, said projection portion being provided with grooves, said bendable sheet being corresponding to said grooves, a central terminal engaging with said hollow portion, and an upper end surface of said central terminal being provided with a sheet type connection portion;

wherein, said connection portion of said central terminal is positioned in said grooves; said grooves further comprise a first groove and a second groove communicated with each other, a diameter of a cross section of said second groove is larger than a diameter of a cross section of said first groove, and said second groove is positioned above said first groove; said bendable sheet is provided with a first projection portion and a second projection portion respectively corresponding to said first groove and said second groove;

whereby, when an inner conducting wire of a coaxial cable is placed on the upper sides of said upper end surface and said connection portion of said central terminal, said connection portion and said bendable sheet are then further allowed to bend to cause said inner conducting wire to be thrust into said grooves and said first projection and said second projection of said bendable sheet to be positioned in said first groove and said second groove respectively to compress the upper side of said inner conducting wire to enable said inner conducting wire and said coupling portion not to contact with each other; in the meantime, the plurality of pairs of tabs respectively buckle said metal housing, said two arms, a ground conductor layer, and an outer insulator layer of said coaxial cable.

2. The connecter according to claim 1, wherein a lower end of said central terminal is provided with two opposite contact sheets used for clamping a male terminal.

3. The connecter according to claim 1, wherein a lower end of said central terminal is provided with two opposite contact sheets used for clamping a male terminal.

4. The connecter according to claim 1, wherein said plurality of tabs are a first pair of tabs, a second pair of tabs, a third pair of tabs and a fourth pair of tabs.

5. The connecter according to claim 4, wherein a lower end of said central terminal is provided with two opposite contact sheets used for clamping a male terminal.

6. The connecter according to claim 1, wherein said two arms are L-type arms.

7. The connecter according to claim 6, wherein a lower end of said central terminal is provided with two opposite contact sheets used for clamping a male terminal.

8. The connecter according to claim 1, wherein a lower end of said central terminal is provided with a male terminal used for clamping by contact sheets of a female terminal.

9. The connecter according to claim 8, wherein said male terminal is a round bar.

10. The connecter according to claim 4, wherein a lower end of said central terminal is provided with a male terminal used for clamping by contact sheets of a female terminal.

11. The connecter according to claim 10, wherein said male terminal is a round bar.

12. The connecter according to claim 6, wherein a lower end of said central terminal is provided with a male terminal used for clamping by contact sheets of a female terminal.

13. The connecter according to claim 12, wherein said male terminal is a round bar.

14. The connecter according to claim 1, wherein a lower end of said central terminal is provided with a male terminal used for clamping by contact sheets of a female terminal.

15. The connecter according to claim 14, wherein said male terminal is a round bar.

* * * * *